US007968787B2

(12) United States Patent
Ueki

(10) Patent No.: US 7,968,787 B2
(45) Date of Patent: Jun. 28, 2011

(54) ELECTRONIC MUSICAL INSTRUMENT AND STORAGE MEDIUM

(75) Inventor: Kazuhisa Ueki, Hamamatsu (JP)

(73) Assignee: Yamaha Corporation (JP)

( * ) Notice: Subject to any disclaimer, the term of this patent is extended or adjusted under 35 U.S.C. 154(b) by 747 days.

(21) Appl. No.: 11/971,312

(22) Filed: Jan. 9, 2008

(65) Prior Publication Data

US 2008/0163746 A1 Jul. 10, 2008

(30) Foreign Application Priority Data

Jan. 9, 2007 (JP) ..... 2007-001348
Jan. 9, 2007 (JP) ..... 2007-001349

(51) Int. Cl.
*G10H 1/08* (2006.01)
*G10H 7/00* (2006.01)

(52) U.S. Cl. ..... 84/626

(58) Field of Classification Search ..... 84/626, 84/615

See application file for complete search history.

(56) References Cited

U.S. PATENT DOCUMENTS 5,918,303 A 6/1999 Yamaura et al.
6,369,310 B1 * 4/2002 Brunson et al. ..... 84/600
7,297,861 B2 * 11/2007 Sunako ..... 84/622
7,385,132 B2 * 6/2008 Komano et al. ..... 84/615
7,385,133 B2 * 6/2008 Shibukawa ..... 84/645
7,649,136 B2 * 1/2010 Uehara ..... 84/610
7,774,078 B2 * 8/2010 Booth et al. ..... 700/94
2003/0177889 A1 * 9/2003 Koseki et al. ..... 84/609
2006/0180010 A1 * 8/2006 Nakazono ..... 84/645
2006/0272483 A1 * 12/2006 Honeywell ..... 84/609
2008/0236372 A1 * 10/2008 Uehara ..... 84/645
2009/0205482 A1 * 8/2009 Shirai et al. ..... 84/612

FOREIGN PATENT DOCUMENTS

JP 2006-276749 A 10/2006

* cited by examiner

*Primary Examiner* — Jeffrey Donels
(74) *Attorney, Agent, or Firm* — Rossi, Kimms & McDowell LLP

(57) ABSTRACT

Audio player, having many items of music content stored therein and having at least a function for reproducing any one of the items of music content stored therein, is instructed to select and reproduce music content, corresponding to a user-designated music piece, from among the items of music content. In response to user's designation of the music piece, the audio player selects, from among the many items of music content, music content corresponding to the designated music piece and reproduces the selected music content. With such arrangements, a user is allowed to appropriately and readily set a performance environment suited for the desired music piece, by using the audio player to actually listen to and check the content of the music piece for which a performance environment is to be set.

10 Claims, 6 Drawing Sheets

ELECTRONIC MUSICAL INSTRUMENT AND STORAGE MEDIUM

BACKGROUND

The present invention relates to electronic musical instruments and programs which can easily and promptly set a performance environment, suited for a manual performance, to (i.e., in accordance with) a music piece which a user wishes to perform. More particularly, the present invention relates to an electronic musical instrument and program which can set a performance environment while actually confirming or checking the content of a music piece using an external audio player.

Heretofore, there have been known electronic musical instruments which have an automatic performance-environment setting function, commonly called "music finder" or the like, for automatically setting, for each user-desired music piece, a performance environment (e.g., a manual-performance tone color, accompaniment style, tempo, effect, etc.) suited for a manual performance where a user operates performance operator members to generate tones. More specifically, pieces of information each for setting an electronic musical instrument to a performance environment suited for a manual environment of a user-desired music piece (this information will hereinafter be referred to as "performance-environment setting information") and pieces of music piece character information, which are each indicative of characters of a music piece, such as a title (music piece name), artist name, player's name, composer's name, lyric writer's name, musical genre, etc. of the music piece and which are associated with the pieces of performance-environment setting information, are stored in advance in a database. Once a user enters some music piece character information, particular performance-environment setting information associated with the entered music piece character is identified, and then a performance environment is automatically set in the electronic musical instrument on the basis of the identified performance-environment setting information. In this manner, it is possible to easily and promptly set a performance environment suited for a music piece to be manually performed by the user itself (himself or herself) operating performance operator members.

However, even an electronic musical instrument having the aforementioned automatic performance-environment setting function would present the problem that, even when a performance environment suited for a selected music piece has been automatically set, it tends to be difficult for the user to manually perform the music piece if the user only knows the title, artist's name, etc. of the music piece and does not exactly know the content of the music piece, such as the lyric, musical score, tune and content of performance or if the user has completely forgot, or vaguely remembers only part of, the content of the music piece. Thus, there has also been proposed a technique that acquires music content (e.g., MIDI data, musical score data, lyric data and the like) pertaining to a desired music piece from a predetermined Web site via a communication network, such as the Internet and then presents the content of the music piece to a user on the basis of the acquired music content. One example of such a technique is disclosed in Japanese Patent Application Laid-open Publication No. 2006-276749. The technique disclosed in the No. 2006-276749 publication not only easily and promptly sets a performance environment for performing a user-desired music piece but also reproduces music content acquired from a Web site, so that the user can not only confirm or check the content of the music piece the user wishes to perform but also manually perform the music piece while being given performance assistance.

However, because there is a need to connect the electronic musical instrument to the communication network, the aforementioned known technique, which acquires music content pertaining to a desired music piece via a communication network and then presents the acquired music content to the user, can not of course be used in an environment where the electronic musical instrument is not connectable to the communication network, for example, because the communication network is inadequate (or has not been developed sufficiently) as an infrastructure or the electronic musical instrument is equipped with no communication interface. Further, the electronic musical instruments must be equipped with a storage device of a great storage capacity for storing acquired music content and a reproduction device for reproducing the acquired music content. However, such electronic musical instruments equipped with these devices tends to be inexpensive, and the aforementioned known technique can not be applied to already-existing electronic musical instruments, which would lead to various inconveniences.

In recent years, portable audio players (media players) have been popularly used, which are equipped with at least a music content storage function and music content reproduction function such that they can not only store many items of music content (digital data, such as MP3 data) in a storage device, such as a hard disk or semiconductor memory, housed in a small casing but also reproduce desired music content selected by a user from among the stored music content. Such audio players can also store, in addition to MP3 data, accessory information added to music content in association with music pieces although each such accessory information is not information directly pertaining to the music piece like the title, musical genre, etc. of the music piece; such accessory information will hereinafter referred to as "music-piece-appendant information" to distinguish from the above-mentioned music piece character information stored in the electronic musical instrument.

However, among the presently-known electronic musical instruments having the above-mentioned automatic performance environment setting information, there has heretofore been none which can effectively use an audio player to automatically set a performance environment in accordance with a user-desired music piece despite a great demand for such a sophisticated electronic musical instrument.

SUMMARY OF THE INVENTION

In view of the foregoing, it is an object of the present invention to provide an improved electronic musical instrument and storage medium which, in setting a performance environment suited for a music piece to be performed by a user, allow the user to confirm or check the music piece, for which the performance environment is to be set, by reproducing the music piece stored in an audio player.

In order to accomplish the above-mentioned object, the present invention provides an improved electronic musical instrument, which comprises: a performance operator unit for a user to perform music performance operation; a storage section that stores, in association with one or more music pieces, one or more pieces of performance environment setting information each for setting a performance environment to be used in the electronic musical instrument when a desired music piece is to be performed by the user using the performance operator unit; a connection interface that connects, to the electronic musical instrument, an audio player having a plurality of items of music content stored therein and having at least a function for reproducing any one of the items of music content stored therein; an input section that inputs user-desired music piece character information as a search condition; an extraction section that, in accordance with the search condition inputted via the input section, extracts, from the storage section, one or more music pieces matching the desired music piece character information; a designation section that designates any one of the one or more music pieces extracted by the extraction section; an instruction section that instructs, via the connection interface, the audio player, connected to the electronic musical instrument, to select, from among the plurality of items of music content stored in the audio player, music content corresponding to the music piece designated by the designation section and reproduce the selected music content; and a performance environment setting section that reads out, from the storage section, the performance environment setting information associated with the designated music piece and automatically sets a performance environment in the electronic musical instrument on the basis of the read-out performance environment setting information.

When a performance environment is to be set for a user-desired (designated) music piece, the audio player, connected to the electronic musical instrument and having many items of music content stored therein and having at least the function for reproducing any one of the items of music content stored therein, is instructed to select and reproduce particular music content, corresponding to the user-designated music piece, from among the items of music content stored therein. Namely, when a performance environment is to be set in the electronic musical instrument using an automatic performance environment setting function and once the user designates a music piece for which such a performance environment is to be set (i.e., music piece to be manually performed), the audio player selects music content corresponding to the designated music piece from among the many items of music content stored therein and reproduces the selected music content. With such inventive arrangements, the user is allowed to appropriately and readily set a performance environment suited for the desired music piece, by using the audio player to actually listen to and thereby check the content of the music piece for which the performance environment is to be set (i.e., music piece to be manually performed).

According to another aspect of the present invention, there is provided an improved electronic musical instrument, which comprises: a performance operator unit for a user to perform music performance operation; a storage section that stores, in association with one or more music pieces, performance environment setting information for setting, in the electronic musical instrument, a performance environment to be used when a desired music piece is to be performed by the user using the performance operator unit; a connection interface that connects, to the electronic musical instrument, an audio player having stored therein a plurality of items of music content and pieces of music-piece-appendant information that are respective character information of the items of music content, the audio player having at least a function for reproducing any one of the items of music content stored therein; a selection section that selects any one of the items of music content stored in the audio player connected to the electronic musical instrument; an instruction section that instructs, via the connection interface, the connected audio player to reproduce the music content selected by the selection section; an acquisition section that acquires, from the connected audio player, the music-piece-appendant information of the selected music content; a retrieval section that, on the basis of the music-piece-appendant information acquired by the acquisition section, retrieves, from the storage section, the performance environment setting information of a music piece corresponding to the selected music content; and a performance environment setting section that automatically sets a performance environment to be used in the electronic musical instrument on the basis of the performance environment setting information retrieved by the retrieval section.

When a performance environment is to be set for a user-desired music piece, the audio player, connected to the electronic musical instrument and having many items of music content stored therein and having at least the function for reproducing any one of the items of music content, is instructed to select and reproduce particular music content, corresponding to the user-designated music piece, from among the items of music content stored therein. Namely, when a performance environment is to be set in the electronic musical instrument using the automatic performance environment setting function, the user can select any one of the many items of music content stored in the audio player, in response to which the audio player reproduces the selected music content; thus, the user can aurally check the content of the music piece through the reproduction. Then, the electronic musical instrument acquires the music-piece-appendant information of the selected music content from the audio player and designates particular performance environment setting information on the basis of the acquired music-piece-appendant information of the selected music content. On the basis of the designated performance environment setting information, a performance environment is set. Thus, the user is allowed to set a performance environment after actually listening to and aurally confirming or checking the content of the music piece by use of the audio player, so that the user can set a performance environment suited for the music piece, easily and appropriately with no error.

Namely, according to the present invention, the electronic musical instrument instructs the audio player, which has many items of music content stored therein and has at least the function for reproducing any one of the items of music content, to select and reproduce particular music content. Then, the audio player reproduces tones stored therein, so that the user can aurally check the content of the music piece, for which a performance environment is to be set, by actually listening to the reproduced tones. Thus, even where the electronic musical instrument is not equipped with a network connection device or storage device, the user can set a suitable performance environment for a music piece to be manually performed, appropriately (with no error) and easily, making effective use of the audio player.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION

Figure 1:
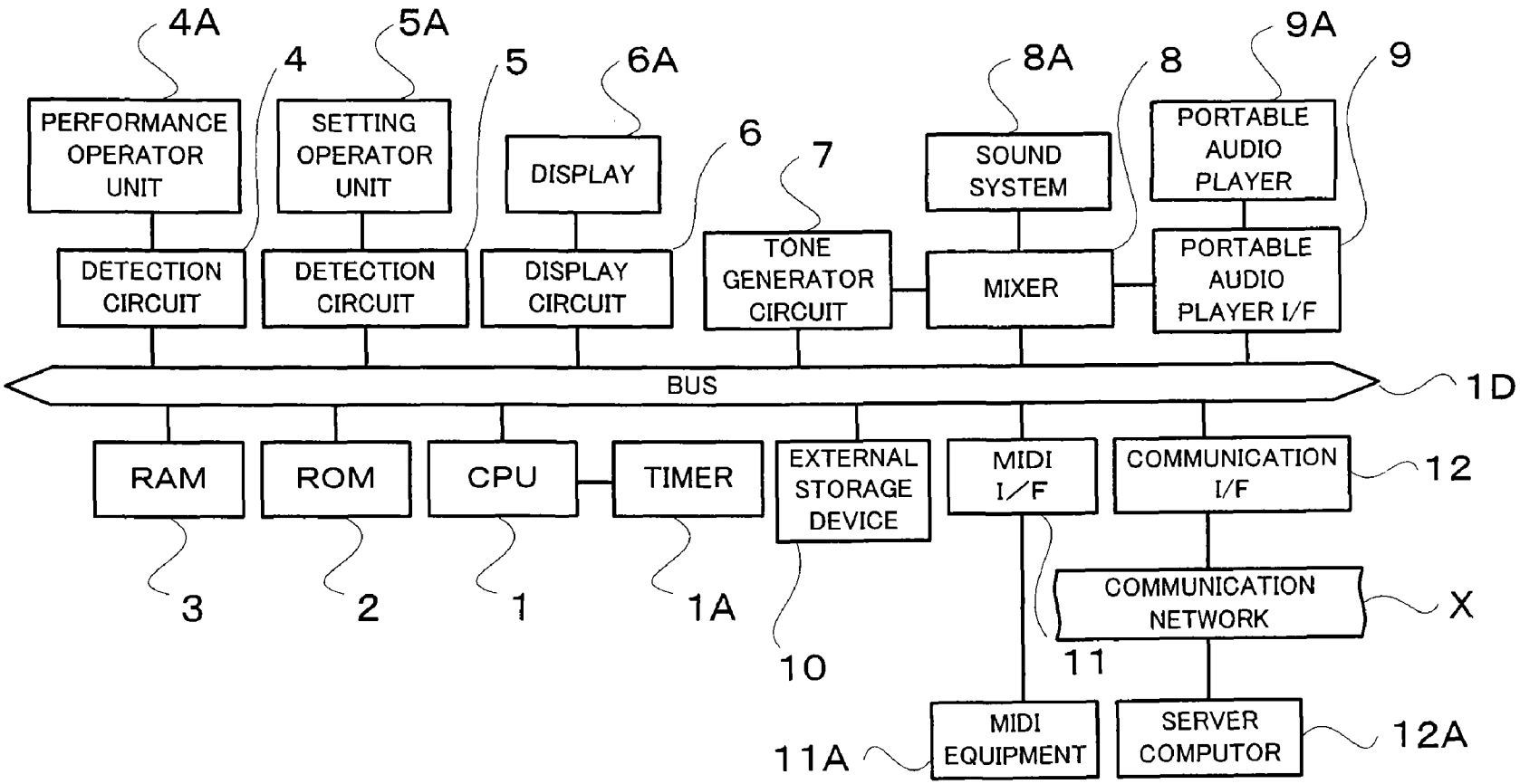
FIG. 1 is a block diagram showing an exemplary general hardware setup of an electronic musical instrument in accordance with a first embodiment of the present invention.

FIG. 1 is a block diagram showing an exemplary general hardware setup of an electronic musical instrument in accordance with a first embodiment of the present invention. The electronic musical instrument of FIG. 1 is controlled by a microcomputer including a microprocessor unit (CPU) 1, a read-only memory (ROM) 2 and a random access memory (RAM) 3. The CPU 1 controls operation of the entire electronic musical instrument. To the CPU 1 are connected, via a data and address bus 1D, the ROM 2, RAM 3, detection circuits 4 and 5, display circuit 6, tone generator circuit 7, mixer 8, portable audio connection interface (I/F) 9, external storage device 10, MIDI interface 11 and communication interface 12. Also connected to the CPU 1 is a timer 1A for counting various times, such as times to signal interrupt timing for timer interrupt processes. For example, the timer 1A generates clock pulses and gives the generated clock pulses to the CPU 1 as processing timing instructions or as interrupt instructions. The CPU 1 carries out various processes in accordance with such instructions.

The ROM 2 stores therein various programs for execution by the CPU 1 and various data. The RAM 3 is used as a working memory for temporarily storing various data generated as the CPU 1 executes predetermined programs, as a memory for storing a currently-executed program and data related to the currently-executed program, and for various other purposes. Predetermined address regions of the RAM 3 are allocated to various functions and used as various registers, flags, tables, memories, etc. Performance operator unit 4A is, for example, a keyboard including a plurality of keys operable to select pitches of tones to be generated and key switches provided in corresponding relation to the keys. The performance operator unit 4A can be used not only for a manual performance by a user itself and for chord entry for an automatic accompaniment but also as an input means for selecting a music piece to be manually performed. The detection circuit 4 detects depression and release of keys of the performance operator unit 4A to thereby produce detection outputs.

Setting operator unit 5A includes various switches, such as a performance setting switch operable to instruct start of automatic setting of a performance environment suited for a music piece to be manually performed, and an automatic accompaniment start/stop switch operable to instruct start/stop of an automatic performance to a manual performance. Of course, the setting operator unit 5A may also include a numeric keypad for inputting numeric value data for selecting, setting and controlling a tone pitch, color, effect, etc., keyboard for inputting characters and letters, and various other operator members, such as a mouse operable to operate a predetermined pointing device displayed on a display 6A. The detection circuit 5 detects an operating state of each of the switches and outputs switch information, corresponding to the detected operating state, to the CPU 1 via the data and address bus 1D.

The display circuit 6 displays, on the display 6A in the form of a liquid crystal display (LCD) panel, CRT or the like, various screens, such as a "search screen" (see FIG. 3), "search result display screen" (see FIG. 5) and "portable audio content display screen" (see FIG. 6), currently-set performance environment, musical score (e.g., musical score of a melody part, musical score indicative of chord input information for an automatic accompaniment part and the like) and the like of a user-selected music piece, controlling state of the CPU 1, etc. By reference to such various information displayed on the display 6A, the user is allowed to readily set a performance environment suited for a manual performance of a user-desired music piece, perform key depression operation for a manual performance on the performance operator unit (keyboard) 4A and perform chord input operation for an automatic accompaniment.

The tone generator circuit 7, which is capable of simultaneously generating tone signals in a plurality of tone generation channels, receives various performance information supplied via the data and address bus 1D, generated in response to manual operation, by the user, of the performance operator unit 4A or generated on the basis of accompaniment pattern data, and generates tone signals on the basis of the received performance information. The mixer 8 mixes a tone signal (audio signal) generated from the tone generator circuit 7 and an audio signal generated from a later-described portable audio player 9A, so that a resultant mixed audio signal is audibly reproduced or sounded via a sound system 8A including an amplifier, speaker, etc. The tone generator circuit 7, mixer 8 and sound system 8A may be constructed in any desired conventionally-known manner. For example, the tone generator circuit 7 may employ any desired tone synthesis method, such as the FM, PCM, physical model or format synthesis method. Further, the tone generator circuit 7 and mixer 8 may be implemented by either dedicated hardware or software processing performed by the CPU 1.

The portable audio connection interface (I/F) 9 is an interface (e.g., USB (Universal Serial Bus)) for connecting an external hardware device, such as a conventional content reproduction device like the portable audio player 9A, to the electronic musical instrument. Via the portable audio connection interface 9, the electronic musical instrument can instruct, as necessary, the external portable audio player 9A to start or stop reproduction of music content stored in the audio player 9A and can acquire tone (audio) signals generated in response to reproduction of the music content by the audio player 9A, as will be later described. The electronic musical instrument is also arranged to acquire various information from the external portable audio player 9A and pass the acquired information to the CPU 1. Whereas same signal lines may be shared between acquisition of the various information and acquisition of the tone signals, separate signal lines may be used or shared for both acquisition of the various information and acquisition of the tone signals. Particularly, if the tone signals are in digital representation, it is preferable that the same signal lines be shared, while, if the tone signals are in analog representation, it is preferable that separate signal lines be used.

The external portable audio player 9A has at least a music content storage function for storing many items of music content comprising digital data, such as MP3 data, into an internal storage device (e.g., hard disk or semiconductor memory) together with music-piece-appendant information and the like, and a music content reproduction function for reproducing (decoding) music content, stored in the internal storage device, in response to user's operation. Namely, unlike an external hard disk device or USB memory (later-described external storage device 10) which can merely store music content, the external portable audio player 9A can not only store music content but also generate tones by reproducing, from among the many items of music content stored therein, randomly or in response to designation by the user. In addition to the above-mentioned functions, the external portable audio player 9A may have other functions, such as a display function for displaying, for example, a list of items of music content stored in the internal storage device, title (music piece name), album name and the like of currently-reproduced music content, etc. on the basis of the music-piece-appendant information. Further, the audio player 9A need not of course be of a portable type.

The external storage device 10 stores performance environment setting information, accompaniment pattern data corresponding to (see FIG. 2) an accompaniment style, various data of manual-performance tone colors, and control-related data, such as various control programs to be executed by the CPU 1. In a case where a particular control program is not prestored in the ROM 2, the control program may be prestored in the external storage device (e.g., hard disk device) 10, so that, by reading the control program from the external storage device 10 into the RAM 3, the CPU 1 is allowed to operate in exactly the same way as in the case where the particular control program is stored in the ROM 2. This arrangement greatly facilitates version upgrade of the control program, addition of a new control program, etc. The external storage device 10 may use any of various removable-type recording media other than the hard disk (HD), such as a flexible disk (FD), compact disk (CD-ROM or CD-RAM), magneto-optical disk (MO) and digital versatile disk (DVD); alternatively, the external storage device 4 may comprise a semiconductor memory.

The MIDI interface 11 functions to input automatic performance data of the MIDI format (i.e., MIDI data) from externally-connected other MIDI equipment 11A or the like to the electronic musical instrument, or output automatic performance data of the MIDI format from the electronic musical instrument to the other MIDI equipment 11A or the like. The other MIDI equipment 11A may be of any type (or operating type), such as a keyboard type, guitar type, wind instrument type, percussion instrument type or gesture type, as long as it can generate MIDI data in response to manual performance operation, by a user, of the equipment.

The communication interface (I/F) 12 is an interface connected to a wired or wireless communication network N, such as a LAN, Internet or telephone line network, via which the electronic musical instrument can be connected to a desired server computer 12A to receive, from the server computer 12A, a control program or various data. For example, if a particular control program or data is not stored in the ROM 2, external storage device (e.g., hard disk) 10 or the like, the communication interface 12 is used for downloading the control program or data from the server computer 12A. It should be appreciated that the communication interface 12 may be of either or both of wired and wireless types.

The electronic musical instrument of the present invention is not limited to the type where all of the performance operator unit 4A, display 6A, tone generator circuit 7, etc. are incorporated together within the body of the musical instrument, and it may of course be of another type where the above-mentioned performance operator unit 4A, display 6A, tone generator circuit 7, etc. are provided separately and interconnected via communication means, such as MIDI interfaces and a communication network. Further, the electronic musical instrument of the present invention is not limited to the aforementioned form and may be constructed as any desired apparatus or equipment, such as a personal computer, karaoke apparatus or game apparatus, as long as it can generate tones in response to manual operation, by the user, of switches or buttons functioning also as performance operator members.

Figure 2:
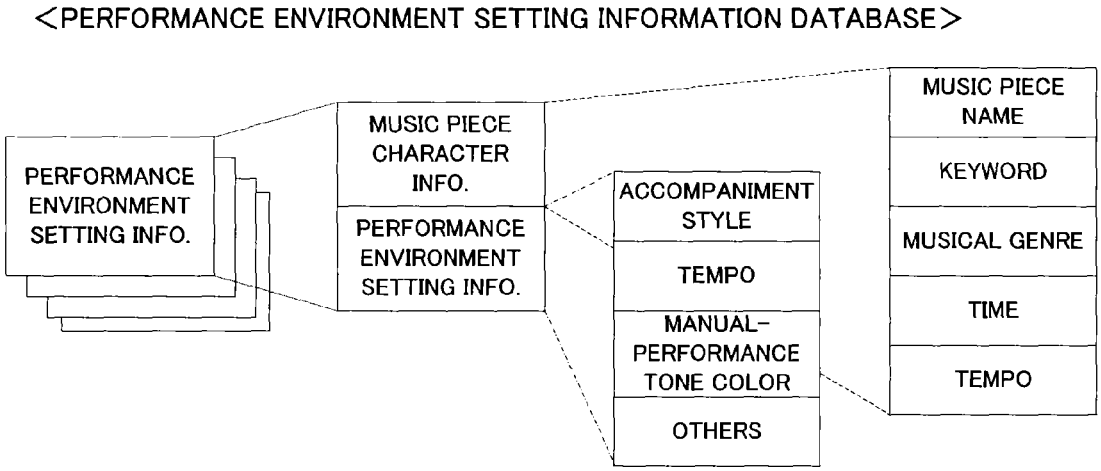
FIG. 2 is a conceptual diagram showing an example of a data organization of performance environment setting information records in the first embodiment of the present invention.

Now, with reference to FIG. 2, a description will be given about "performance environment setting information records" that are recorded as a database in the ROM 2, external storage device 10 or the like and that are used by the user to set the electronic musical instrument to a performance environment suited for a music piece to be manually performed by the user. FIG. 2 is a conceptual diagram showing an example data organization of the performance environment setting information records.

Each of the performance environment setting information records generally comprises "music piece character information" and "performance environment setting information". The performance environment setting information comprises data defining a performance environment of the electronic musical instrument suited for the user to manually perform the music piece characterized by the music piece character information that will be later described in detail. In the instant example, settings of an "accompaniment style" indicating accompaniment pattern data for an automatic accompaniment, "tempo" indicating a performance speed at which the user should execute performance operation and "manual performance tone color" of tones to be generated in response to user's manual performance operation and one or more other settings related to a performance environment are included in the performance environment. Examples of the other settings include settings of volume balance between tones to be generated in response to user's manual performance operation and automatic accompaniment tones, type of an effect to be imparted to tones, chord progression of tones, split information for splitting or dividing the keyboard into a key range to be used for a manual performance and a key range to be used for entry of chords for the automatic accompaniment, and the like. Needless to say, the information of the tempo, tone color, etc. defined in the performance environment setting information need not necessarily be the same as a tempo, tone color, etc. of the original music piece (characterized by the music piece character information).

The music piece character information is information plainly indicative of characters of a music piece for which a performance environment set on the basis of the above-mentioned performance environment setting information is considered suited as a performance environment to be used when the user executes a manual performance. In the instant example, the music piece character information includes information of: a "title" indicative of the name of the music piece; one or more "keywords" that comprise words and/or the like pertaining to the music piece; "musical genre", such as pops, rock, classic, Japanese ballad ("enka") or jazz, of the music piece; "time" (i.e., the number of beats in a measure) of an original music piece; and "tempo" indicative of a performance speed of the original music piece. As will be later described in detail, in response to the user entering at least one of the various items of information as defined in the music piece character information, one or more music pieces corresponding to the entered information can be extracted, and particular performance environment setting information" can be specified by the user selecting a desired one of the extracted music pieces.

Because the instant example is based on the assumption that a music piece performance is executed in response to user's manual performance operation instead of being automatically executed on the basis of reproduction of automatic performance data, setting of such a performance environment suited for a manual performance can be performed in advance, prior to the start of the manual performance, by the user itself using the aforementioned performance environment setting information, rather than being performed during a performance as an event in sequence data, such as MIDI data. Thus, the following paragraphs describe an operational sequence for setting a performance environment suited for a manual performance by the user itself.

Figure 3:
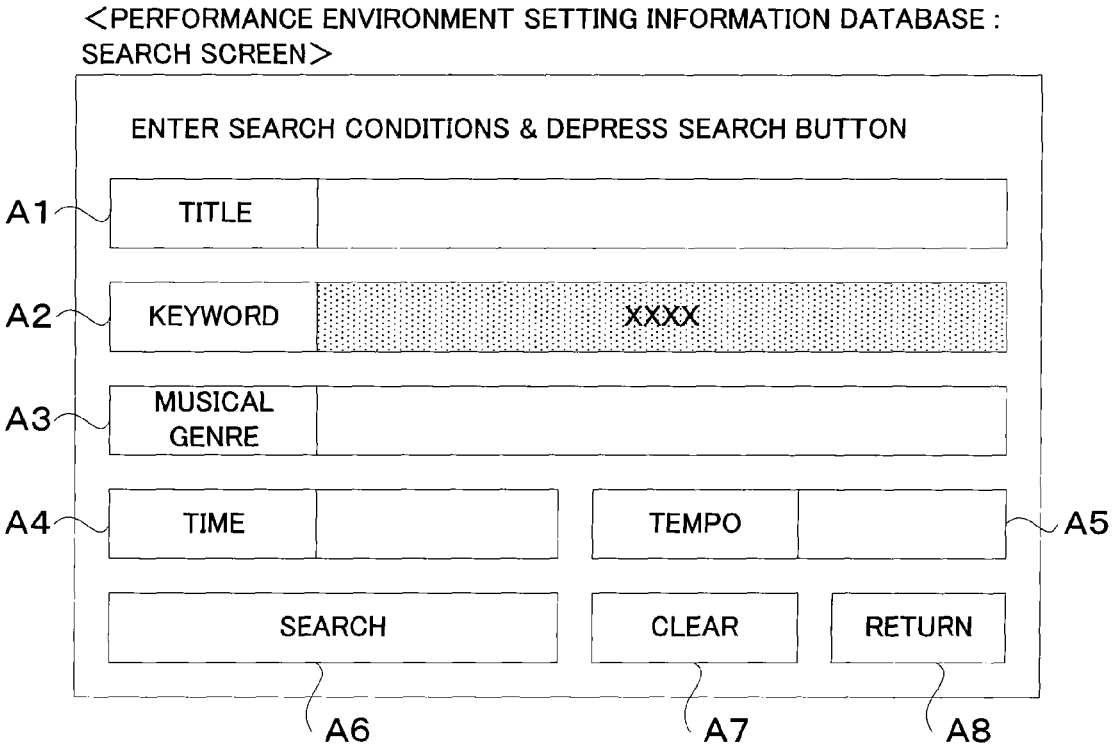
FIG. 3 is a conceptual diagram showing an example of a search screen in the first embodiment of the present invention.

In a first example of the operational sequence, the user enters search conditions for setting a performance environment. First, with reference to FIG. 3, a description will be given about a "search screen" which the aforementioned "performance environment setting information" is associated with and which allows the user to extract a music piece for which a performance environment can be set easily and promptly. FIG. 3 is a conceptual diagram showing an example of the search screen.

As shown in FIG. 3, the search screen includes (i.e., shows), as input areas for the user to enter search conditions, a "title" input area A1, "keyword" input area A2, "musical genre" input area A3, "time" input area A4, and "tempo" input area A5. In order to search for a music piece for which a performance environment may be automatically set, the user enters search conditions pertaining to the items, "title", "keyword", "musical genre", "time" and "tempo", as defined in the above-mentioned music character information (see FIG. 2). The user can enter, into the input area A1-A5, desired search conditions (e.g., words, sentences, numeric values and/or the like related to "title", "keyword", "musical genre", "time" and "tempo"), and the "music piece character information" of the "performance individual environment setting information records" in the database is referenced, in accordance with at least one of the entered search conditions, so that a "performance environment setting information record" matching the at least one search condition can be extracted as a search result. In the illustrated example of FIG. 3, "xxxx" entered in the "keyword" input area A2 is used as a search condition so that an operation is performed for searching and extracting a "performance environment setting information record" including "xxxx" as the keyword information of the "music piece character information" thereof.

On the "search screen", a "search" button A6, "clear" button A7 and "return" button A8 are displayed in addition to the above-mentioned search condition input areas A1-A5. The "search" button A6 is a switch operable to start a search for a corresponding "performance environment setting information record" in accordance with the search conditions entered in the input areas A1-A5. The "clear" button A7 is switch operable to clear or delete the search conditions entered in the input areas A1-A5, i.e. to update the electronic musical instrument to a state where no search condition is entered. In the illustrated example of FIG. 3, the search condition "xxxx" entered in the "keyword" input area A2 is deleted in response to user's operation of the "clear" button A7 so that the electronic musical instrument is updated to a state where no search condition is entered. At that time, either only a portion or all of the search conditions entered in the input areas A1-A5 may be cleared in response to operation of the "clear" button A7. The "return" button A8 is a switch operable to return the display to the last screen (i.e., screen immediately preceding the currently-displayed screen); in the illustrated example of FIG. 3, the display 6A is returned to a screen (i.e., not-shown last screen) immediately preceding the "search screen". If the display 6A is a touch panel, the individual buttons can be operated by depression of the buttons displayed thereon, but if the display 6A is not a touch panel and switches corresponding to the buttons are provided near the displayed positions of the buttons, then the buttons can be operated by depression of the corresponding switches.

Figure 4:
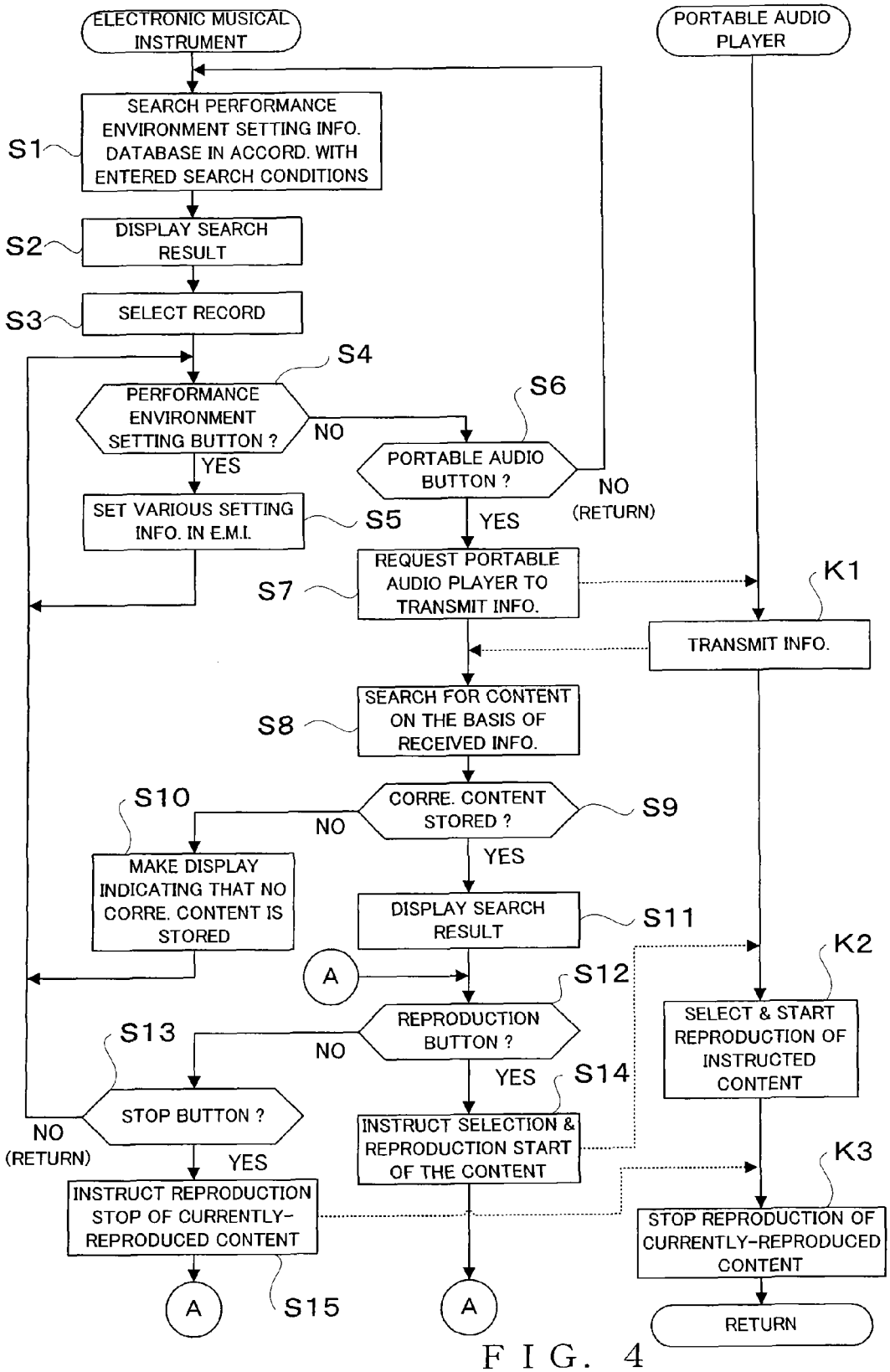
FIG. 4 is a flow chart showing an example operational sequence of automatic performance environment setting processing performed in the first embodiment of the present invention.

Next, with reference to FIG. 4, a description will be given about an operational sequence of "automatic performance environment setting processing" which implements an automatic performance environment setting function for automatically setting a performance environment suited for a user-desired music piece. FIG. 4 is a flow chart showing an example operational sequence of the "automatic performance environment setting processing". The "automatic performance environment setting processing" is performed while predetermined information is being communicated between the electronic musical instrument and the portable audio player connected to the electronic musical instrument, and thus, processing performed respectively in the electronic musical instrument and the portable audio player are shown together in the figure and will be described in accordance with the order of the operational sequence. The processing performed in the electronic musical instrument is a software program that is started up in response to operation of the performance setting switch, and the electronic musical instrument displays the "search screen" (see FIG. 3) on the display 6A in response to the start-up and is placed in a standby state after the start-up. The processing performed in the portable audio player, on the other hand, is a software program started up in response to powering-on of the portable audio player, and the audio player is placed in a standby state after the start-up.

First, at step S1, the electronic musical instrument searches through the performance environment setting information database (see FIG. 2) in accordance with search conditions entered by the user in the search areas A1-A5 of the search screen and in response to user's operation (depression, click operation or the like) of the search button A6 of the search screen (FIG. 3), to extract, from the database, one or more music pieces matching desired music piece character information entered by the user as the search conditions. If the clear button A7 is operated without the search button A6 being operated on the search screen, each selected one or all of the search conditions entered in the input areas A1-A5 are deleted, and the user is prompted to enter search conditions again. If the return button A8 is operated without the search button A6 being operated on the search screen, the "automatic performance environment setting processing" is brought to an end, and the display 6A is updated backward (returned) from the search screen to the last screen (not shown). At next step S2, the search result extracted in accordance with the search conditions is displayed as a "search result display screen" (see FIG. 5 to be described later). Namely, the display 6A is updated from the search screen to the search result display screen.

At step S3, a music piece (more specifically, performance environment setting information record) for which a performance environment is to be set in response to user's operation is selected using the "search result display screen" (see FIG. 5) displayed on the display 6A. At step S4, a determination is made as to whether a performance environment setting button B2 has been operated. With a YES determination at step S4 (i.e., if the performance environment setting button B2 has been operated as determined at step S4), various setting information is set in the electronic musical instrument (E.M.I.), at step S5. Namely, at step S5, the performance environment setting information (see FIG. 2) of the selected music piece (performance environment setting information record) is read out from the performance environment setting information database, and a performance environment is automatically set in the electronic musical instrument on the basis of the read-out performance environment setting information. If, on the other hand, the performance environment setting button B2 has not been operated (NO determination at step S4), a further determination is made, at step S6, as to whether a portable audio button B3 has been operated on the search result display screen. If the portable audio button B3 has not been operated, i.e. if the return button B4, not the performance environment setting button B2 or portable audio button B3, has been operated, (NO determination at step S6), the display 6A is updated backward from the "search result display screen" to the "search screen", and then the electronic musical instrument reverts to the operation of step S1.

If, on the other hand, the portable audio button B3 has been operated (YES determination at step S6), the electronic musical instrument requests the portable audio player 9A, connected to the musical instrument via the portable audio connection interface 9, to transmit predetermined information, related to the selected music piece and stored in the portable audio player 9A, to the electronic musical instrument. Once such a request (command) is received from the electronic musical instrument, the portable audio player 9A locates or designates the predetermined information related to the selected music piece and returns the predetermined information, related to the selected music piece to the electronic musical instrument, at step K1. The predetermined information related to the selected music piece which the portable audio player 9A returns to the electronic musical instrument is information related to all items of music content stored in the portable audio player 9A, such as a list of items of music content stored in the player 9A, including titles and pieces of music-piece-appendant information (each indicative of an album name, artist name, musical genre, time and tempo of a music piece) attached to the individual music content.

Once the returned music-content-related information (i.e., music content list and music-piece-appendant information) is received from the portable audio player 9A, a search is made, at step S8, to see as to whether the music content corresponding to the performance environment setting information record selected at step S3 above is currently stored in the portable audio player 9A. For example, a search is made through the portable audio player 9A for music content agreeing in title with the performance environment setting information record selected at step S3, such as by comparing the music content list returned from the portable audio player 9A and the music piece character information of the selected performance environment setting information record stored in the database. Alternatively, a search is made through the portable audio player 9A for music content agreeing in musical genre, time and tempo with the performance environment setting information record selected at step S3, by comparing the music-piece-appendant information returned from the portable audio player 9A and the music piece character information of the selected performance environment setting information record stored in the database.

At step S9, a determination is made, in accordance with a result of the above search, as to whether any music content corresponding to the selected performance environment setting information record is stored in the portable audio player 9A. With a NO determination at step S9, that no music content corresponding to the selected performance environment setting information record is currently stored in the portable audio player 9A is informed to the user, such as by making a display to that effect on the display 6A (step S10), and then the electronic musical instrument reverts to step S4. If, on the other hand, music content corresponding to the selected performance environment setting information record is stored in the portable audio player 9A (YES determination at step S9), a "portable audio content display screen" (see FIG. 6 to be described later) is displayed on the display 6A on the basis of the music-content-related information (music content list and music-piece-appendant information) returned from the portable audio player 9A (step S11).

Figure 5:
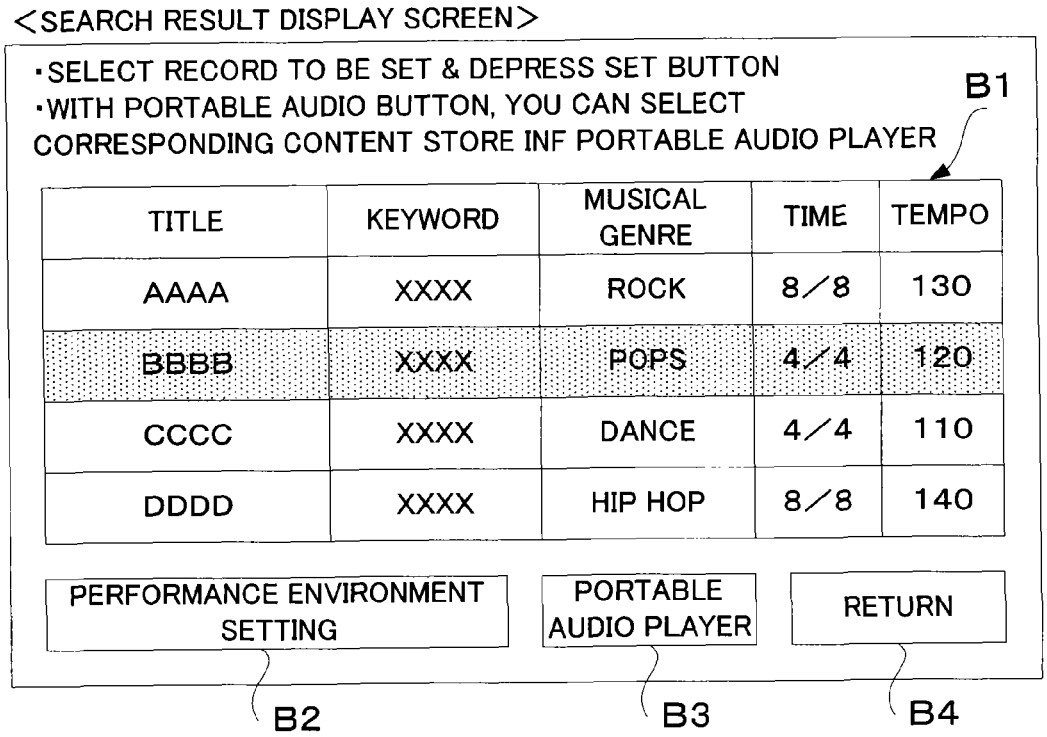
FIG. 5 is a conceptual diagram showing an example of a search result display screen in the first embodiment of the present invention.

Now, with reference to FIG. 5, a description will be given about the "search result display screen" (see step S2 of FIG. 4). FIG. 5 is a conceptual diagram showing an example of the "search result display screen". The "search result display screen" of FIG. 5 includes (i.e., shows) a search result display area B1 for indicating the search result extracted in accordance with the search conditions, "performance environment setting" button B2, "portable audio" button B3 and "return" button B4. The search result display area B1 is an area for displaying the search result on the basis of the music piece character information of the performance environment setting information record (see FIG. 2), having information matching the search conditions, extracted from the database. Namely, the individual information, "title", "keyword", "musical genre", "time" and "tempo", is displayed in the search result display area B1. If, for example, "xxxx" has been entered as a search condition into the "keyword" input area A2 on the "search screen" shown in FIG. 3, an operation is performed for searching for and extracting a performance environment setting information record including the search condition "xxxx" in the keyword information of the music piece character information, and thus one or more performance environment setting information records where the keyword is "xxxx" is displayed as the search result. In the illustrated example of FIG. 5, four performance environment setting information records with respective titles "AAAA"-"DDDD" are displayed as the searched-out records where the keyword is "xxxx".

The user can select a desired record from among the one or more records displayed in the search result display area B1, and after that, a performance environment can be automatically set for the selected record by the user operating the "performance environment setting" button B2. Namely, the "performance environment setting" button B2 is a switch operable to set a performance environment in accordance with the selected record. In the illustrated example, a performance environment setting information record with the title "BBBB" has been selected (here, the record selected is indicated by a highlighted display). If the "performance environment setting" button B2 is operated in such a record selected state, a performance environment suited for a manual performance of the music piece having the title "BBBB" is automatically set on the basis of the record (specifically, performance environment setting information) with the title "BBBB".

If, on the other hand, the portable audio button B3 has been operated, a search is made through the portable audio player 9A, connected to the electronic musical instrument, for music content, currently stored in the audio player 9A, which matches in "title", "musical genre", "time", "tempo", etc. (namely, music piece character information of a performance environment setting information record) displayed in the search result display area B1, and the search result is displayed on the display 6A as a "portable audio content display screen". The "portable audio content display screen" will be later described in relation to FIG. 6. The "return" button B4 is a switch operable to return the display to the last screen; here, the display 6A is updated backward or returned to the "search screen" (see FIG. 3) immediately preceding the "search result display screen". If many performance environment setting information records have been extracted in accordance with the search conditions and if these many records can not be simultaneously displayed on the "search result display screen", then the records may be displayed on different pages of the "search result display screen", one or more records per page. In such a case, an arrangement is of course made to allow the user to check the search result on a page-by-page basis in response to user's designation of desired pages or the like.

Figure 6:
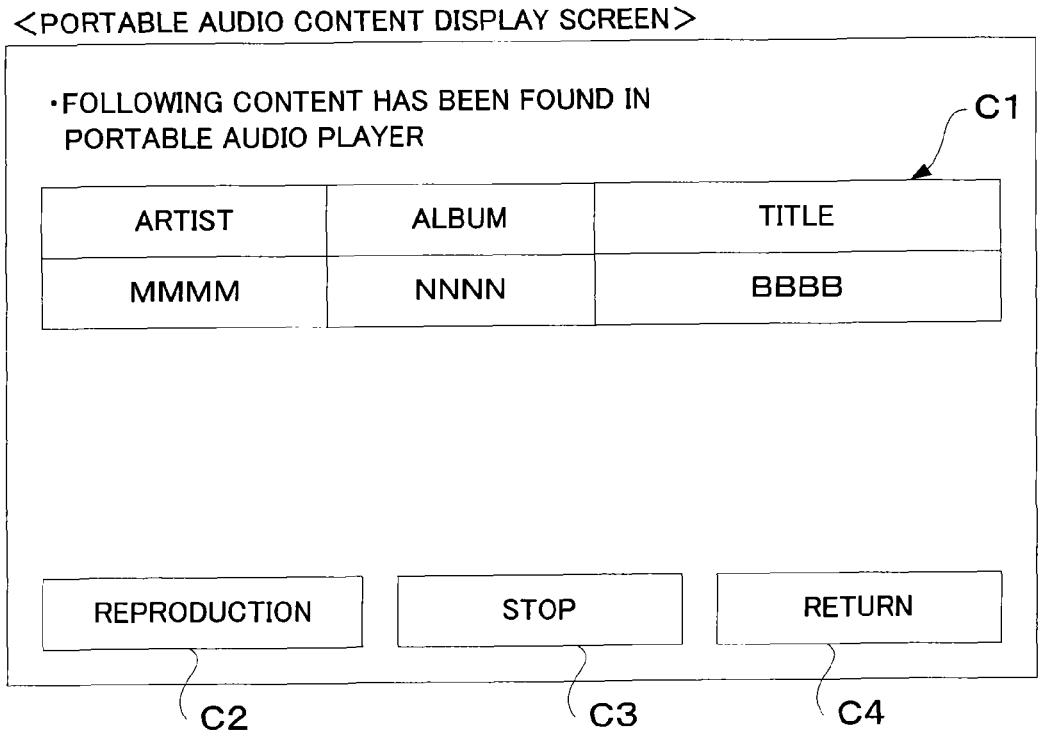
FIG. 6 is a conceptual diagram showing an example of a portable audio content display screen in the first embodiment of the present invention.

Referring back to the flow chart of FIG. 4, a determination is made, at step S12, as to whether a reproduction (or play) button C2 has been operated on the "portable audio content display screen" (FIG. 6). If the reproduction button C2 has been operated (YES determination at step S12), the electronic musical instrument instructs the portable audio player 9A, connected to the electronic musical instrument, to select one of the music content displayed on the "portable audio content display screen" and start reproduction of the selected music content (step S14). Once such a selecting and reproducing instruction (command) is received from the electronic musical instrument, the portable audio player 9A selects corresponding music content from among the multiplicity of items of music content stored therein and start reproduction of the selected music content (step K2). Tone (audio) signals generated in response to generation of the selected music content are sent from the portable audio player 9A to the electronic musical instrument and audibly generated in the electronic musical instrument by means of the sound system 8A. Namely, the user can confirm or aurally check what the music piece of the music content stored in the portable audio player 9A is like (i.e., the content of the music piece) by directly listening to the tones generated from the electronic musical instrument.

If the reproduction button C2 has not been operated on the "portable audio content display screen" (NO determination at step S12), a further determination is made, at step S13, as to whether the stop button C3 has been operated on the "portable audio content display screen". If the stop button C3 has not been operated, i.e. if a return button C4, not the reproduction button C2 or stop button C3, has been operated, (NO determination at step S13), the display 6A is updated backward or returned from the "portable audio content display screen" to the "search result display screen" immediately preceding the "portable audio content display screen", and the electronic musical instrument reverts to step S4. Thus, by the user giving an instruction such that a YES determination is made at step S4, performance environment setting information of portable audio content can be set in the electronic musical instrument. If, on the other hand, the stop button C3 has been operated (YES determination at step S13), the electronic musical instrument requests the portable audio player 9A, connected to the musical instrument, to stop reproduction of the music content being currently reproduced in the portable audio player 9A, at step S15. Once such a reproduction stop instruction (command) is received from the electronic musical instrument, the portable audio player 9A stops the reproduction of the music content being currently reproduced, at step K3.

FIG. 6 is a conceptual diagram showing an example of the "portable audio content display screen" (see step S11 of FIG. 4). The "portable audio content display screen" of FIG. 6 includes (i.e., shows) a search result display area C1, "reproduction (or play)" button C2, "stop" button C3 and "return" button C4. The search result display area C1 is an area for displaying the search result of the search operation (see step S8), i.e. the result of searching through the music content list, returned from the portable audio player 9A, on the basis of the music piece character information of the selected performance environment setting information record. If the search result shows that music content corresponding to the selected performance environment setting information record is stored in the portable audio player 9A, individual information, "artist", "album" and "title", is displayed in the search result display area C1 on the basis of the music content list and music-piece-appendant information. If no music content corresponding to the selected performance environment setting information record is stored in the portable audio player 9A, a display indicating that no music content corresponding to the selected performance environment setting information record is made in the portable audio player 9A is displayed on the display 6A, although not particularly shown.

The "reproduction" button C2 is a switch operable to instruct the portable audio player 9A to select and reproduce particular music content corresponding to the selected performance environment setting information record. Namely, once the user operates the "reproduction" button C2, the portable audio player 9A selects such corresponding music content from among the multiplicity of items of music content stored therein and starts reproduction of the selected music content. The "stop" button C3 is a switch operable to instruct the portable audio player 9A to stop the reproduction of the music content being currently reproduced by the player 9A. Namely, once the user operates the "stop" button C3, the portable audio player 9A stops the reproduction of the music content (i.e., music content corresponding to the user-selected performance environment setting information record) being currently reproduced by the player 9A. The "return" button C4 s a switch operable to return the display to the last screen; in this case, the display 6A is updated backward or returned from the "portable audio content display screen" to the "search result display screen" (FIG. 5) immediately preceding the "portable audio content display screen".

Figure 7:
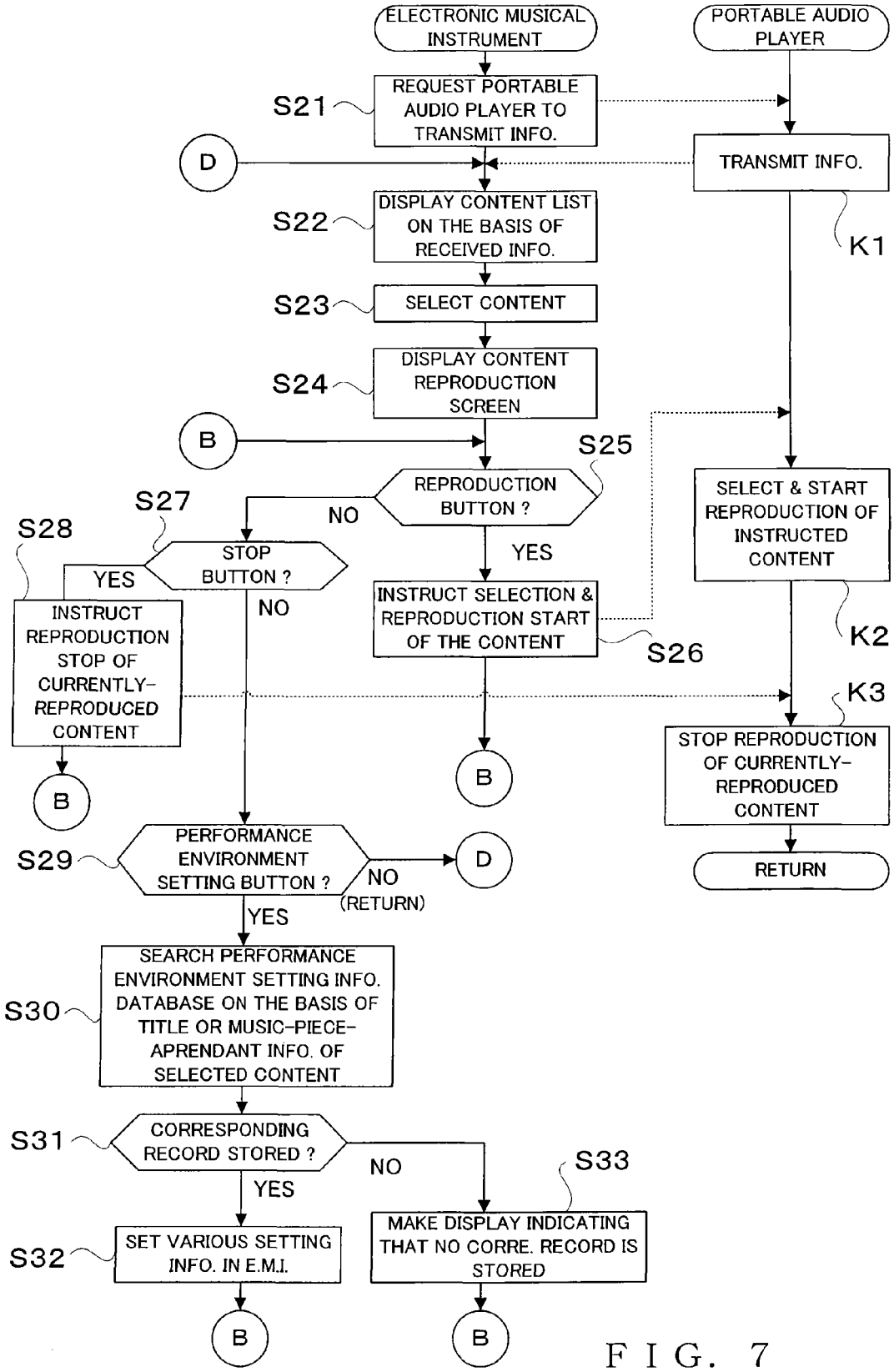
FIG. 7 is a flow chart showing an example operational sequence of automatic performance environment setting processing performed in a second embodiment of the present invention.
Figure 8:
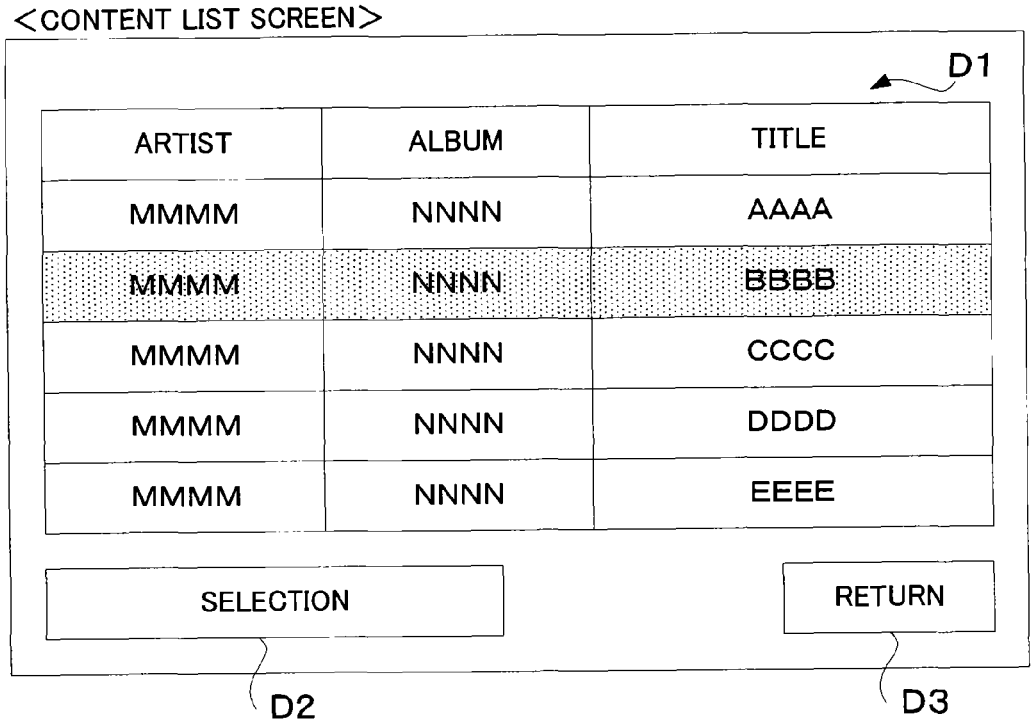
FIG. 8 is a conceptual diagram showing an example of a content list screen in the second embodiment of the present invention.
Figure 9:
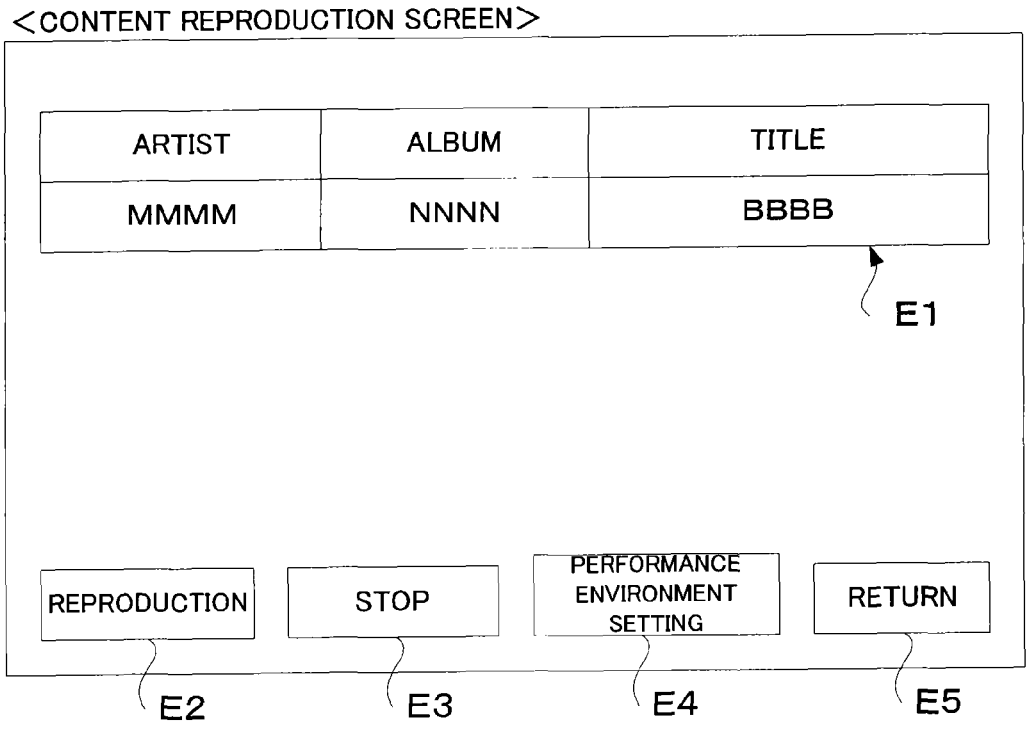
FIG. 9 is a conceptual diagram showing an example of a content reproduction screen in the second embodiment of the present invention.

The following paragraphs describe a second embodiment of the present invention, with reference to FIGS. 7-9.

First, with reference to FIG. 7, a description will be given about an operational sequence of "automatic performance environment setting processing" performed in the second embodiment of the present invention which implements an automatic performance environment setting function for automatically setting a performance environment suited for a user-desired music piece. The "automatic performance environment setting processing" is performed while predetermined information is being communicated between the electronic musical instrument and the portable audio player connected to the electronic musical instrument, and thus, processing performed respectively in the electronic musical instrument and the portable audio player are shown together in the figure and will be described in accordance with the order of the operational sequence. The processing performed in the electronic musical instrument is a software program started up in response to operation of the performance setting switch. The processing performed in the portable audio player, on the other hand, is a software program started up in response to powering-on of the portable audio player, and the audio player is placed in a standby state after the start-up.

First, at step S21, the electronic musical instrument instructs the portable audio player 9A, connected to the electronic musical instrument, to transmit predetermined information pertaining to all of music pieces (items of music content) stored in the player 9A. Specifically, the electronic musical instrument transmits a command instructing the player 9A to execute the above-mentioned information transmission. Once such a request (command) is received from the electronic musical instrument, the portable audio player 9A returns, to the electronic musical instrument, the predetermined information pertaining to all of the music pieces (items of music content) stored in the player 9A, at step K1. The predetermined information pertaining to all of the music pieces which the portable audio player 9A returns to the electronic musical instrument is, for example, a list of music content including titles (i.e., list of stored music content) and pieces of music-piece-appendant information (each indicative of an album name, artist name, musical genre, time and tempo of a music piece) attached to the individual music content.

Upon receipt of the music-content-related information (music content list and music-piece-appendant information) returned from the portable audio player 9A, the electronic musical instrument displays a "content list screen" (see FIG. 8 to be later described) on the display 6A, at step S22. At next step S23, the electronic musical instrument selects music content in response to user's selection of music content on the "content list screen" and user's operation (e.g., depression or clock operation) of a "selection" button D2. If a "return" button D3 has being operated on the "content list screen" without the "selection" button D2 being operated, the "automatic performance environment setting processing" is brought to an end, and the display 6A is updated (returned) from the "content list screen" to the last screen (not shown). At step S24, a "content display section" (see FIG. 9) is displayed for the selected music content. If the display 6A is a touch panel, the individual buttons can be operated by depression of the buttons displayed thereon, but if the display 6A is not a touch panel and switches corresponding to the buttons are provided near the displayed positions of the buttons, then the buttons can be operated by depression of the corresponding switches.

Here, the "content list screen" (step S22 of FIG. 7) and "content reproduction screen" (step S24 of FIG. 7) will be described in detail with reference to corresponding figures. FIG. 8 is a conceptual diagram showing an example of the "content list screen", which includes a content list display area D1, "selection" button D2 and "return" button D3. The content list display area D1 is an area for displaying a list of all of the items of music content stored in the portable audio player 9A on the basis of the music-content-related information (music content list and music-piece-appendant information) returned from the portable audio player 9A. More specifically, respective pieces of information of "titles" defined in the music content list and "artist" and "album" defined in the music-piece-appendant information are displayed in the content list display area D1. In the illustrated example of FIG. 7, a list of five items of music content with respective titles "AAAA"-"EEEE" contained in an album "NNNN" released by an artist "MMMM" is displayed on the "content list screen" as music content stored in the audio player 9A.

The user can select desired music content from among one or more music items of content displayed in the content list display area D1. In the illustrated example, the music content with the title "BBBB" has been selected (in the figure, the music content selected is indicated by a highlighted display). If the "selection" button D2 is operated in such a record selected state, only the selected music content is extracted and displayed as the "content reproduction screen" (FIG. 9). The "return" button D3 is a switch operable to return the display to the last screen; in the illustrated example, the display 6A is updated or returned to a screen (i.e., not-shown last screen) immediately preceding the "content list screen". If great many items of music content are stored in the portable audio player 9A and if these items of music content can not be simultaneously displayed on the "content list display screen", these items of music content may be displayed on different pages, one or more items of music content per page. In such a case, an arrangement is of course made to allow the user to check the music content on a page-by-page basis in response to user's designation of desired pages or the like.

FIG. 9 is a conceptual diagram showing an example of the "content reproduction screen" (see step S24 of FIG. 8), which includes a content-in-question display area E1, "reproduction" button E2, "stop" button E3, "performance environment setting" button E4 and "return" button E5. The content-in-question display area E1 is an area for extractively displaying only music content selected by the user on the "content list screen". For example, respective pieces of information, "title", "artist" and "album", are displayed in the content-in-question display area E1 on the basis of the music content list and music-piece-appendant information corresponding to the user-selected music content, similarly to those on the "content list screen".

The "reproduction" button E2 is a switch operable to instruct the portable audio player 9A to select and reproduce the music content displayed in the content-in-question display area E1. Namely, once the user operates the "reproduction" button E2, the portable audio player 9A selects the music content, displayed in the content-in-question display area E1, from among the multiplicity of items of music content stored therein and starts reproduction of the selected music content. The "stop" button E3 is a switch operable to instruct the portable audio player 9A to stop the reproduction of the music content being currently reproduced by the player 9A. Namely, once the user operates the "stop" button E3, the portable audio player 9A stops the reproduction of the music content (i.e., music content selected by the user) being currently reproduced by the player 9A.

The "performance environment setting" button E4 is a switch operable to automatically set the electronic musical instrument to a performance environment most suitable for manually performing the music content (user-selected music content) displayed in the content-in-question display area E1. Namely, by operating the "performance environment setting" button E4, the user can easily and promptly set a manual performance environment most suitable for the selected music content. In the illustrated example, once the "performance environment setting" button E4 is operated, the electronic musical instrument searches for a performance environment setting information record with the title "BBBB", by referring to the "music piece character information" of the individual "performance environment setting information records" in the database on the basis of information corresponding to the selected music content among the music content list and music-piece-appendant information having been acquired from the portable audio player 9A. Then, a performance environment suited for manually performing the music piece "BBBB" is automatically set on the basis of the performance environment setting information of the searched-out performance environment setting information record. The "return" button E5 is a switch operable to return the display to the last screen; in the illustrated example, the display 6A is updated or returned to the "content list screen" (see FIG. 8) immediately preceding the "content reproduction screen".

Referring back to the flow chart of FIG. 7, a determination is made, at step S25, as to whether the reproduction button E2 has been operated on the "content reproduction screen" (FIG. 9). If the reproduction button E2 has been operated (YES determination at step S25), the electronic musical instrument instructs the portable audio player 9A, connected to the electronic musical instrument, to select user-desired desired music content displayed on the "content reproduction screen" and start reproduction of the selected music content (step S26).

Once such a selecting and reproducing instruction (command) is received from the electronic musical instrument, the portable audio player 9A selects the corresponding music content from among the multiplicity of items of music content stored therein and start reproduction of the selected music content (step K2). Tone (audio) signals generated in response to generation of the music content are sent from the portable audio player 9A to the electronic musical instrument and audibly generated in the electronic musical instrument by means of the sound system 8A. Namely, the user can check what the music piece of the music content stored in the portable audio player 9A is like (i.e., the content of the music piece) by directly listening to the tones generated from the electronic musical instrument.

If the reproduction button E2 has not been operated on the "content reproduction screen" (NO determination at step S25), a further determination is made, at step S27, as to whether the stop button E3 has been operated on the "content reproduction screen". If the stop button E3 has been operated (YES determination at step S27), the electronic musical instrument requests the portable audio player 9A, connected to the musical instrument, to stop reproduction of the music content being currently reproduced in the portable audio player 9A, at step S28. Once such a reproduction stop instruction (command) is received from the electronic musical instrument, the portable audio player 9A stops the reproduction of the music content being currently reproduced, at step K3. If, on the other hand, the stop button E3 has not been operated (NO determination at step S27), a further determination is made, at step S29, as to whether the performance environment setting button E4 has been operated. With a YES determination at step S29, the electronic musical instrument searches through the performance environment setting information database (see FIG. 2), at step S30. For example, the electronic musical instrument searches for a performance environment setting information record agreeing in title or musical genre, time, tempo, etc. with the selected music content, by comparing the music content list and music-piece-appendant information stored in and transmitted from the portable audio player 9A and the music character information of the performance environment setting information stored in the database. If, on the other hand, the performance environment setting button E4 has not been operated, i.e. if the return button E5, not the reproduction button E2 or performance environment setting button E4, has been operated, (NO determination at step S29), the display 6A is updated backward or returned from the "content reproduction screen" to the "content list screen" immediately preceding the "content reproduction screen", and then the electronic musical instrument reverts to step S22.

At step S31, a determination is made, in accordance with a result of the aforementioned record search operation, as to whether any performance environment setting information record corresponding to the selected music content is currently stored in the database of the electronic musical instrument. If there is stored no performance environment setting information record corresponding to the selected music content (NO determination at step S31), that no music content record corresponding to the selected music content is stored in the electronic musical instrument is informed to the user, such as by making a display indicating to that effect on the display 6A (step S33), and the electronic musical instrument reverts to step S24. If, on the other hand, there is currently stored a performance environment setting information record corresponding to the selected music content (YES determination at step S31), various setting information is set in the electronic musical instrument at step S32, and the electronic musical instrument reverts to step S24. Namely, the performance environment setting information of the performance environment setting information record (see FIG. 2) related to the selected music content is read out, so that a performance environment is automatically set in the electronic musical instrument on the basis of the read-out performance environment setting information.

As set forth above, the first and second embodiments of the present invention are constructed so that, when the user wants to set a performance environment of the electronic musical instrument using the automatic performance environment setting function, music content, corresponding to a music piece for which the user wants the performance environment to be set (i.e., which the user wants to perform manually) is selected and reproduced. Thus, even where a communication network is inadequate (or has not been developed sufficiently) as an infrastructure and the user can not connect the electronic musical instrument to the communication network, or where the user's electronic musical instrument is not equipped with a communication interface, the present invention allows the user readily set to appropriately (i.e., with no error) a performance environment suited for a music piece to be performed, by using the portable audio player to actually listen to the reproduction of the music piece for which a performance environment is to be set and thereby check what the music piece to be performed is like i.e., the content of the music piece). Further, because the electronic musical instrument gives a music content selection/reproduction instruction to the portable audio player to cause the portable audio player to reproduce desired music content, the electronic musical instrument itself need not have a music content reproduction function. For example, where the music content is compressed audio data, it is not necessary to provide the electronic musical instrument with a function for decoding and reproducing data of a special format. Furthermore, because any one of great many items of music content prestored in the portable audio player can be used, it is not necessary to prestore music content in the electronic musical instrument, and thus no particular storage device (capacity) is required for storing many items of music content.

Note that, in the aforementioned automatic performance environment setting processing of FIG. 4, tones generated on the basis of reproduction, by the portable audio player, desired music content may be sounded directly by the portable audio player, rather than by the electronic musical instrument, so that the user can check the content of the music piece by listening to the tones generated by the audio player.

Automatic accompaniment can be started in the electronic musical instrument, in synchronism with music content reproduction by the portable audio player, in response to user's operation of the reproduction button C2 on the "portable audio content display screen" (see FIG. 6) in the first embodiment or in response to user's operation, during a manual performance, of the reproduction button E2 on the "content reproduction screen" (see FIG. 9) in the second embodiment. In such a case, the performance environment setting information (see FIG. 2) of a performance environment setting information record stored in the electronic musical instrument may be modified or replaced on the basis of the music-piece-appendant information of the music content. For example, the accompaniment style of the performance environment setting information may be changed on the basis of the musical genre of the music-piece-appendant information, or the tempo of the performance environment setting information may be modified on the basis of the tempo of the music-piece-appendant information.

When the portable audio player 9A returns predetermined music-piece-related information to the electronic musical instrument, information related to all of the items of music content stored in the portable audio player 9A need not necessarily be returned. For example, the portable audio player 9A may make a search to see whether or not music content corresponding to the selected performance environment setting information record is currently stored in the audio player 9A, and the portable audio player 9A may return the music-piece-appendant information of only the searched-out music content to the electronic musical instrument.

Note that the automatically-set performance environment may be changed as desired by the user. Further, the performance environment setting information may be updated in accordance with a performance environment changed by the user. Further, new performance environment setting information may be additionally registered by way of the external storage device or communication interface.

This application is based on, and claims priority to, JP PA 2007-001348 filed on 9 Jan. 2007 and JP PA 2007-001349 filed on 9 Jan. 2007. The disclosure of the priority applications, in its entirety, including the drawings, claims, and the specification thereof, is incorporated herein by reference.

What is claimed is:

1. An electronic musical instrument comprising:

a performance operator unit for a user to perform music performance operation;

a storage section that stores, in association with at least one music piece, at least one piece of performance parameter setting information each for setting a performance parameter to be used in said electronic musical instrument when a desired music piece is to be performed by the user using said performance operator unit;

a connection interface that connects, to said electronic musical instrument, an external audio player having a plurality of items of music content stored therein and that reproduces any one of the items of music content stored therein;

an input section that inputs user-desired music piece character information as a search condition;

an extraction section that, in accordance with the search condition input via said input section, extracts, from said storage section, at least one music piece matching the desired music piece character information;

a designation section that designates any one of the at least one music piece extracted by said extraction section;

an instruction section that instructs, via said connection interface, the external audio player to select, from among the plurality of items of music content stored in the external audio player, particular music content corresponding to the music piece designated by said designation section and reproduce the selected music content; and a performance parameter setting section that reads out, from said storage section, the performance parameter setting information associated with the designated music piece and automatically sets a performance parameter in said electronic musical instrument on the basis of the read-out performance parameter setting information.

2. The electronic musical instrument as claimed in claim 1, further comprising:

an acquisition section that acquires, from the external audio player, a list of the items of music content stored in the external audio player, wherein when, on the basis of the list of the items of music content acquired by said acquisition section, the music content corresponding to the designated music piece is determined to be currently stored in the external audio player, said instruction section instructs the external audio player to select and reproduce the music content corresponding to the designated music piece.

3. The electronic musical instrument as claimed in claim 1, further comprising:

an acquisition section that acquires, from the external audio player, a list of the items of music content stored in the external audio player and at least one piece of music-piece-appendant information that is respective character information of the items of music content and stored in the external audio player in association with individual ones of the items of music content, wherein when, on the basis of the music-piece-appendant information acquired by said acquisition section, the music content corresponding to the designated music piece is determined to be currently stored in the external audio player, said instruction section instructs the external audio player to select and reproduce the music content corresponding to the designated music piece.

4. The electronic musical instrument as claimed in claim 1, further comprising:

an acquisition section that acquires, from the external audio player, at least one piece of music-piece-appendant information that is respective character information of the items of music content and stored in the external audio player in association with individual ones of the music content; and an editing section that, on the basis of the music-piece-appendant information acquired by said acquisition section, modifies or replaces the performance parameter setting information stored in said storage section in association with a corresponding one of the music pieces.

5. The electronic musical instrument as claimed in claim 1, wherein the performance parameter setting information includes at least one of information for setting a tone color to be used in a manual performance, information for setting an automatic accompaniment style, information for setting a performance tempo, or information for setting a tone effect.

6. The electronic musical instrument as claimed in claim 1, wherein the music piece character information includes information indicative of at least one of a title, musical genre, performer, composer, lyric writer, tempo, or time of a music piece.

7. A non-transitory computer-readable storage medium storing a program executable by a controller of an electronic musical instrument to carry out a method of setting a performance parameter in the electronic musical instrument, said electronic musical instrument including a connection interface for accessing an external audio player, a storage section that stores, in association with at least one music piece, at least one piece of performance parameter setting information each for setting a performance parameter to be used in said electronic musical instrument when a desired music piece is to be performed by a user using a performance operator unit, said method comprising the steps of:

accessing the external audio player via the connection interface provided in said electronic musical instrument, the external audio player having a plurality of items of music content stored therein and that reproduces any one of the items of music content stored therein;

inputting user-desired music piece character information as a search condition;

extracting, in accordance with the input search condition from the storage section, at least one music piece matching the desired music piece character information;

designating any one of the extracted at least one music piece;

instructing, via the connection interface, the external audio player to select, from among the plurality of items of music content stored in the external audio player, particular music content corresponding to the designated music piece and reproduce the selected music content; and reading out, from the storage section, the performance parameter setting information associated with the designated music piece and automatically setting a performance parameter to be used in said electronic musical instrument on the basis of the read-out performance parameter setting information.

8. An electronic musical instrument comprising:

a performance operator unit for a user to perform music performance operation;

a storage section that stores, in association with at least one music piece, at least one piece of performance parameter setting information each for setting a performance parameter to be used in said electronic musical instrument when a desired music piece is to be performed by the user using said performance operator unit;

a connection interface that connects said electronic musical instrument to an external audio player having stored therein a plurality of items of music content and at least one piece of music-piece-appendant information that is respective character information of the items of music content, the external audio player reproducing any one of the items of music content stored therein;

a selection section that selects any one of the items of music content stored in the external audio player connected to said electronic musical instrument;

an instruction section that instructs, via said connection interface, the external audio player to reproduce the music content selected by said selection section;

an acquisition section that acquires, from the external audio player, the music-piece-appendant information of the selected music content;

a retrieval section that, on the basis of the music-piece-appendant information acquired by said acquisition section, retrieves, from said storage section, the performance parameter setting information of a music piece corresponding to the selected music content; and a performance parameter setting section that automatically sets a performance parameter to be used in said electronic musical instrument on the basis of the performance parameter setting information retrieved by said retrieval section.

9. The electronic musical instrument as claimed in claim 8, further comprising an editing section that, on the basis of the music-piece-appendant information acquired by said acquisition section, modifies or replaces the performance parameter setting information of the music piece that is stored in said storage section and corresponds to the selected music content.

10. A non-transitory computer-readable storage medium storing a program executable by a controller of an electronic musical instrument to carry out a method of setting a performance parameter in the electronic musical instrument, said electronic musical instrument including a connection interface and a storage section that stores, in association with at least one music piece, at least one piece of performance parameter setting information each for setting a performance parameter to be used in said electronic musical instrument when a desired music piece is to be performed by a user using a performance operator unit, said method comprising the steps of:

accessing the external audio player via the connection interface provided in said electronic musical instrument, the external audio player having stored therein a plurality of items of music content and music-piece-appendant information that is respective character information of the items of music content, the external audio player reproducing any one of the items of music content stored therein;

permitting a selection of any one of the music content stored in the external audio player connected to said electronic musical instrument;

instructing, via said connection interface, the external audio player to reproduce the selected music content;

acquiring, from the external audio player, music-piece-appendant information of the selected music content;

retrieving, on the basis of the acquired music-piece-appendant information music content, from the storage section, the performance parameter setting information of a music piece corresponding to the selected music content; and automatically setting a performance parameter to be used in said electronic musical instrument on the basis of the retrieved performance parameter setting information.

* * * * *